United States Patent [19]

Schultz

[11] Patent Number: 4,648,778

[45] Date of Patent: Mar. 10, 1987

[54] LOG LIFTER

[76] Inventor: Lester W. Schultz, Rte. 3, Osakis, Minn. 56360

[21] Appl. No.: 717,671

[22] Filed: Mar. 29, 1985

[51] Int. Cl.[4] ..... B66C 23/60

[52] U.S. Cl. ..... 414/626; 248/168; 248/439; 254/324; 254/342; 414/23; 414/444; 414/450; 414/460; 414/911; 414/745

[58] Field of Search ..... 248/168, 439; 414/23, 414/745, 626, 427, 444, 453, 454, 455, 456, 460, 592, 911, 450; 16/326, 333; 254/323, 324, 342, 266, 263; 242/106; 269/17, 46

[56] References Cited

U.S. PATENT DOCUMENTS

| | | | |
|---|---|---|---|
| 491,168 | 2/1893 | Griffith | 254/342 X |
| 1,439,245 | 12/1922 | Knapp | 414/626 |
| 1,732,153 | 10/1929 | Crichton | 414/444 |
| 1,784,264 | 12/1930 | Young | 248/168 |
| 2,299,584 | 10/1942 | Low | 16/333 X |
| 2,656,212 | 10/1953 | Eckstein | 414/626 X |
| 2,687,866 | 8/1954 | Johnson | 248/168 |
| 3,094,802 | 6/1963 | Perry | 248/168 X |
| 3,716,216 | 2/1973 | Kirkpatrick | 254/266 |
| 4,218,045 | 8/1980 | Weismann | 254/323 |

*Primary Examiner*—Frank E. Werner

[57] ABSTRACT

A log lifter particularly designed to elevate a portion of a large log to facilitate cutting the log into shorter lengths, wherein the log lifter includes a collapsible support frame with a hoist mechanism mounted thereon and a log gripping clamp connected with the hoist mechanism for lifting the log.

5 Claims, 5 Drawing Figures

LOG LIFTER

BACKGROUND OF THE INVENTION

In the past, the end portions of a heavy log to be cut up have been difficult to elevate and in most instances, this has been done by lever mechanisms with elevating members inserted between the ground and the log.

SUMMARY OF THE INVENTION

This invention includes a collapsible support stand which is adapted to straddle a log to be elevated and which has a hoisting mechanism supported thereon with a log gripping tong member for connecting the hoisting mechanism to the log to elevate the engaged portion of the log.

DETAILED DESCRIPTION OF THE PREFERRED EMBODIMENT

Figure 1:
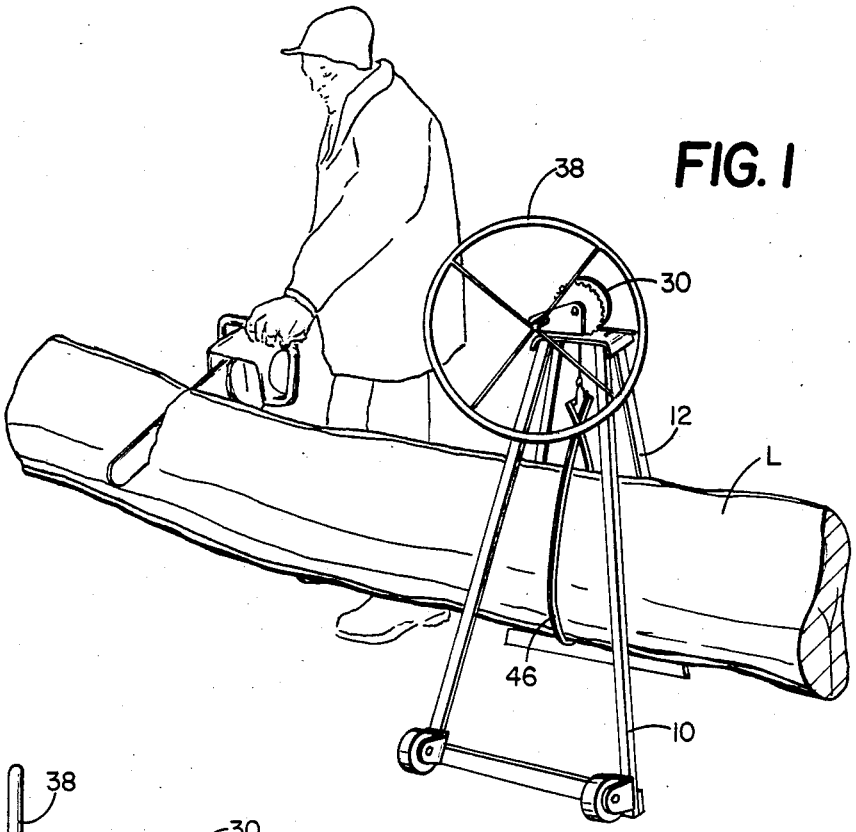
FIG. 1. is a perspective view of my invention in operative position showing a portion of a log elevated thereby.

A log lifter embodying my invention is illustrated in the accompanying drawings and includes a pair of supporting leg structures 10 and 12. A mounting platform 14 is rigidly connected to the upper end of the leg structure 10 as by being welded thereto. The other leg structure 12 is pivotally connected to the platform 14 by means of a pivot shaft 16. The portion of this pivotal connection formed at the top of the leg structure 12 is provided by an elongated sleeve 18 fixed to the top of the legs 12 as by a connecting plate 20.

Figure 2:
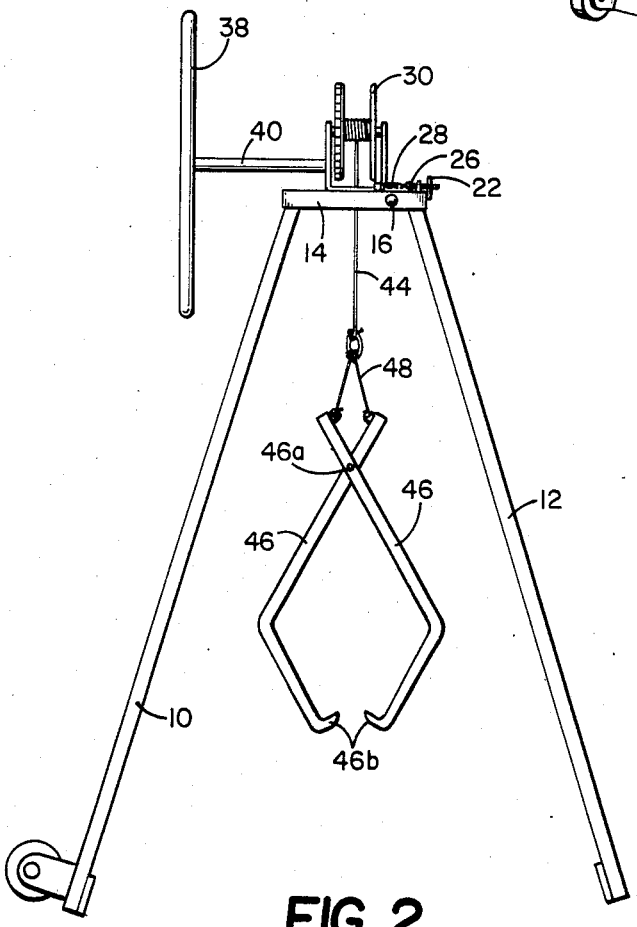
FIG. 2 is an end elevational view of my log lifter.

The mounting plate 14 has a pair of depending flanges **14*a* through which the connecting shaft 16 is inserted with the sleeve 18 interposed therebetween. When the leg structure 12 is in extended operative position as best shown in FIG. 2, the top of the connecting plate 20 will engage the bottom surface of the mounting plate 14 disposed thereabove to form a positive rigid support for the leg structure 12. The leg structure 12 is held in extended operative position by a latch mechanism having a latch element 22 fixed to the edge portion of connecting plate 20 and having a notch 22*a* aligned with a releasable latch hook 24 having an operating handle 26. The latch hook 24 is pivotally mounted on the top of the mounting plate 14 as shown and a tension spring 28 urges the same into latched position. The end of the hook has a cam surface 24*a* for engaging the inner end of the notch 22*a* to cam the hook outwardly away from the inner end of the notch 22*a* to permit the hook to pass through the notch and ultimately close into latched position on the outside of the latch element 22**.

Figure 3:
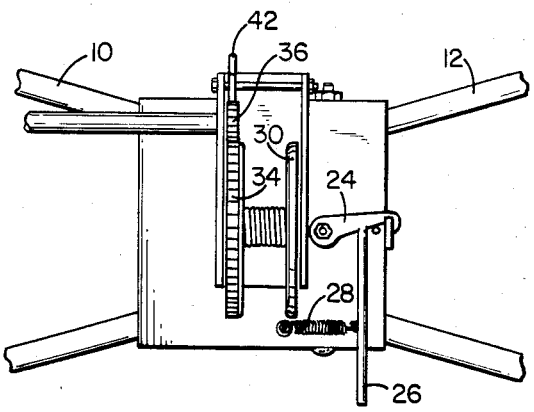
FIG. 3 is a top plan view thereof.
Figure 4:
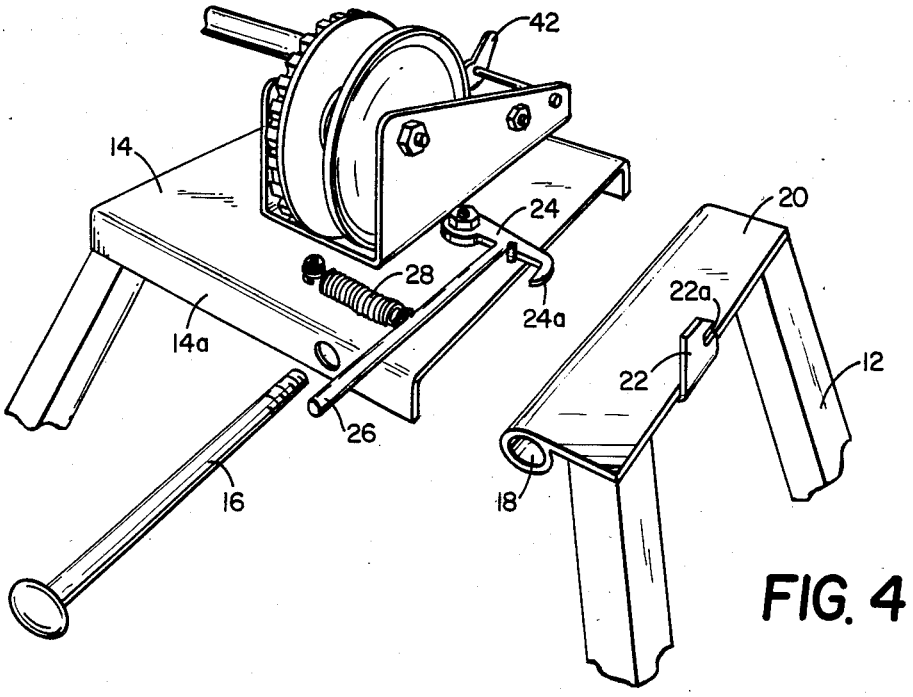
FIG. 4 is an exploded perspective view specifically showing the connection between the supporting legs of the frame.
Figure 5:
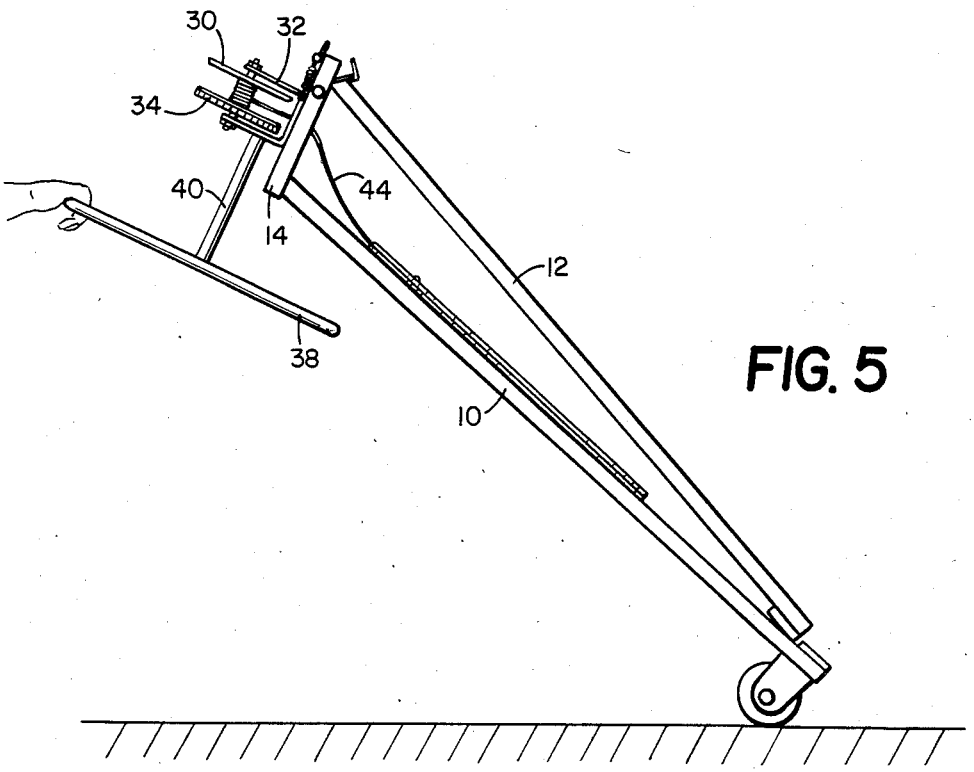
FIG. 5 is an end elevational view of the lifter unit with the legs shown in collapsed position.

A hoisting mechanism is mounted on the top of the plate and includes a flanged winding drum 30 journaled between the supporting elements of a bracket 32 fixed to the top of the mounting plate 14 as illustrated. One of the flanges of the winding drum has a gear wheel 34 fixed thereto and a driving pinion 36 is meshed therewith as best shown in FIG. 3. An operating wheel 38 is fixed to a drive shaft 40 which, in turn, is fixed to the pinion 36 to rotate the same. A locking pawl 42 is provided to positively hold the pinion wheel 36 against rotation. A cable 44 is connected to the drum 30 and is wound thereon between the flanges thereof as illustrated and extends through a suitable opening in the central portion of the mounting plate 14 as illustrated.

In the form shown, a log gripping unit in the form of a pair of pivotally connected tong elements 46 is provided, having the intermediate pin **46*a* thereof formed in spaced relation to the upper ends of the tong levers 46. The cable 44 is connected to the upper ends of the levers 46 as by a connecting yoke member 48 as best shown in FIG. 2**.

The operator moves the leg structure into position where the log L is straddled between the two legs. The tong levers 46 are then expanded around the log and the lower hook elements **46*b* are closed against the log to securely grip the same. The hoist is then actuated to take up the cable 44** and lift the log into the desired position to facilitate cutting thereof.

It is to be understood that while there has been illustrated and described certain forms of the present invention, the invention is not to be limited to the specific form or arrangement of parts herein described and shown except to the extent that such limitations are found in the claims.

What is claimed is:

1. A log lifter comprising, a supporting frame including first and second supporting leg structures, each generally defining separate planes and each having upper and lower ends, adapted to receive a log therebetween and extend thereabove;

a top mounting plate fixed to the upper end of the first leg structure and having a top and bottom surface, a pair of depending flanges fixed in spaced-apart relation to said mounting plate and extending below the bottom surface thereof, said flanges having pivot-receiving openings therein aligned to lie in a plane parallel to the plane of the leg structure to which the mounting plate is fixed, a hoisting mechanism mounted on the top surface of the mounting plate, a log gripping unit connected to the hoisting mechanism and disposed below said mounting plate and being adapted to be removably attached to a log to grip the same, a connecting plate pivotally mounted between said depending flanges and fixed to the top of the second leg structure and arranged with respect to the mounting plate so that a substantial portion of the top surface of the connecting plate engages a substantial portion of the bottom surface of the mounting plate when the two leg structures are in spread-apart relation to rigidly support the two leg structures in spread-apart relation, and latch means connected with said two plates to positively hold the same in engaged surface-to-surface relation with the leg structures in operative spread-apart relation.

2. The structure set forth in claim 1 wherein the log gripping unit constitutes a pair of gripping tong lever elements pivotally connected together at their intermediate upper portions with means for connecting above the pivot point the upper portions of said lever elements to said hoist mechanism to close the lower gripping portions against the log to be lifted.

3. The structure set forth in claim 1 and a pivot sleeve underlying said connecting plate in fixed relation thereto and a pivot pin extending through the sleeve and the openings in the flanges of the mounting plate to pivotally connect the two plates.

4. The structure set forth in claim 1 and a pair of wheels mounted on the bottom end of one of said first leg structures to facilitate moving the same.

5. The structure set forth in claim 1 and said latch mechanism comprising, a pivoted latch element mounted on the top of said mounting plate and having a hook on the end thereof and having a return spring for holding the same in closed position, said pivoted latch element having a portion extending beyond the edge of said mounting plate, and a fixed latch element fixed to said connecting plate and extending upwardly thereabove with a latch-receiving recess formed therein to receive the pivoted latch element and positively lock the top surface of the connecting plate in engaged relation to the bottom surface of the mounting plate.

* * * * *